US006136104A

United States Patent [19]

Miyafuji et al.

[11] Patent Number: 6,136,104

[45] Date of Patent: Oct. 24, 2000

[54] COPPER ALLOY FOR TERMINALS AND CONNECTORS AND METHOD FOR MAKING SAME

[75] Inventors: Motohisa Miyafuji; Hirofumi Arai; Koya Nomura, all of Shimonoseki, Japan

[73] Assignee: Kobe Steel, Ltd., Kobe, Japan

[21] Appl. No.: 09/348,290

[22] Filed: Jul. 7, 1999

[30] Foreign Application Priority Data

Jul. 8, 1998 [JP] Japan ..... 10-193442

[51] Int. Cl.[7] ..... C22C 9/02; C22C 9/04

[52] U.S. Cl. ..... 148/433; 148/682; 148/683; 420/470; 420/472; 420/476

[58] Field of Search ..... 420/470, 472, 420/476; 148/433, 682, 683

[56] References Cited

U.S. PATENT DOCUMENTS

| | | | |
|---|---|---|---|
| 4,591,484 | 5/1986 | Miyafuji et al. | 420/481 |
| 4,656,003 | 4/1987 | Miyafuji et al. | 420/473 |
| 4,687,633 | 8/1987 | Miyafuji et al. | 420/481 |

FOREIGN PATENT DOCUMENTS

| | | |
|---|---|---|
| 61-127840 | 6/1986 | Japan . |
| 62-199741 | 9/1987 | Japan . |
| 63-286544 | 11/1988 | Japan . |
| 3-10035 | 1/1991 | Japan . |
| 3-6341 | 1/1991 | Japan . |
| 3-100132 | 4/1991 | Japan . |
| 4-280936 | 10/1992 | Japan . |
| 7150273 | 6/1995 | Japan . |

*Primary Examiner*—Sikyin Ip

*Attorney, Agent, or Firm*—Oblon, Spivak, McClelland, Maier & Neustadt, P.C.

[57] ABSTRACT

A copper alloy which is adapted for use as terminals and connectors, which comprises from 0.1 wt % to less than 0.5 wt % of Ni, from larger than 1.0 wt % to less than 2.5 wt % of Sn, from larger than 1.0 wt % to 15 wt % of Zn, and further comprises from at least one element selected between from 0.0001 wt % to less than 0.05 wt % of P and from 0.0001 wt % to 0.005 wt % of Si, and the balance being Cu and inevitable impurities The alloy has an electrical conductivity of 90% or below relative to a maximum electrical conductivity of an annealed copper alloy and an area ratio of insoluble matters such as precipitates is 5% or below.

14 Claims, 3 Drawing Sheets

(× 90000)

(×90000)

(×90000)

COPPER ALLOY FOR TERMINALS AND CONNECTORS AND METHOD FOR MAKING SAME

BACKGROUND OF THE INVENTION

1. Field of the Invention

This invention relates to a copper alloy which is adapted for use as terminals, connectors, wire harnesses and the like. More particularly, the invention relates to a copper alloy which is suitably employed for general and industrial purposes and also for automobiles and is excellent in stress relaxation resistance characteristic and peeling off resistance of solder. The invention also relates to a method for making such an alloy.

2. Description of Related Art

For the purposes mentioned above, there have been hitherto used copper alloys including brass, phosphor bronze and the like. However, a recent trend toward the miniaturization of terminals and connectors needs electrical conductivity and strength higher than those of brass and phosphor bronze. Moreover, as pitches between pins of parts become narrower, there has arisen the problem that migration takes place. It will be noted that the term "migration" used herein means short-circuiting which is caused by bringing about moisture condensation between electrodes to ionize an metallic element of the electrode, migrating the ionized metallic element toward a cathode by the action of the Coulomb's force and depositing the element thereon, and causing metal deposits to be grown from the cathode in a dendritic form, like plating (electrodeposition), thereby arriving at the anode side.

In order to cope with this situation, Japanese Laid-open Patent No. 62-199741 proposes a Cu—Sn—Ni—P alloy which has good strength and good migration resistance and which can suppress stress corrosion cracking from occurring. However, with terminals and connectors, which are employed for general and industrial purposes and mounted on automobiles (especially around engines), the temperature on their use arrives at about 150° C. Thus, it is strongly required to improve strength under high temperature conditions, and particularly, to keep spring characteristics and improve a stress relaxation characteristic. However, when using conventional manufacturing methods, such requirements have not been met satisfactorily.

The alloy proposed in Japanese Laid-open Patent Application No. 62-199741 is a precipitation hardening alloy, and a batch (2 hours) step is adopted for intermediate annealing, thus inviting the formation of phosphides. Such long-time annealing leads to non-efficiency in productivity, thus resulting in the cost rise.

SUMMARY OF THE INVENTION

It is accordingly an object of the invention to provide a copper alloy which overcomes the problem of the prior art counterparts.

It is another object of the invention to provide a copper alloy for terminals and connectors, which has a good stress relaxation resistance characteristic along with good strength, migration resistance, resistance to stress corrosion crack, peeling off resistance of solder (thermal resistance of soldered layer to peel off) and the like.

It is a further object of the invention to provide a method for making such a copper alloy as mentioned above.

The above objects can be achieved, according to one embodiment of the invention, by a copper alloy for terminals and connectors, which comprises from 0.1 wt % to less than 0.5 wt % of Ni, from larger than 1.0 wt % to less than 2.5 wt % of Sn, from larger than 1.0 wt % to 15 wt % of Zn, and further comprises from at least one element selected between from 0.0001 wt % to less than 0.05 wt % of P and from 0.0001 wt % to 0.005 wt % of Si, and the balance being Cu and inevitable impurities.

It is preferred that the copper alloy should comprise S in an amount exceeding 0.0005 wt % but below 0.005 wt %, O in an amount of 50 ppm or below, and H in an amount of 10 ppm or below.

Moreover, the copper alloy should further comprise from 0.0001 to 1 wt %, in total, of at least one element selected from the group consisting of Ti, Mg, Ag and Fe provided that the content of Ti ranges from 0.0001 to 0.2 wt %, that of Mg ranges from 0.0001 to 0.2 wt %, that of Ag ranges from 0.0001 to 0.2 wt %, and that of Fe ranges from 0.0001 to 0.6 wt %.

If necessary, the copper alloy may further comprise one or more of Ca, Mn, Be, Al, V, Cr, Co, Zr, Nb, Mo, In, Pb, Hf, Ta, B, Ge and Sb in a total amount of 1 wt % or below.

According to another embodiment of the invention, there is provided a method for making a copper alloy for terminals and connectors, which comprises, after hot rolling of the alloy, if necessary, subjecting the alloy to cold rolling during which the alloy is annealed at least once and recrystallized, further subjecting to final cold rolling, and stabilized by annealing. In order to obtain a good stress relaxation resistance characteristic, after the stabilization by annealing, the alloy should have an electrical conductivity of 90% or below relative to a maximum electrical conductivity attained after the stabilization annealing. Alternatively, the area ratio of insoluble matters, such as precipitates, should be at 5% or below.

PREFERRED EMBODIMENTS OF THE INVENTION

Figure 1:
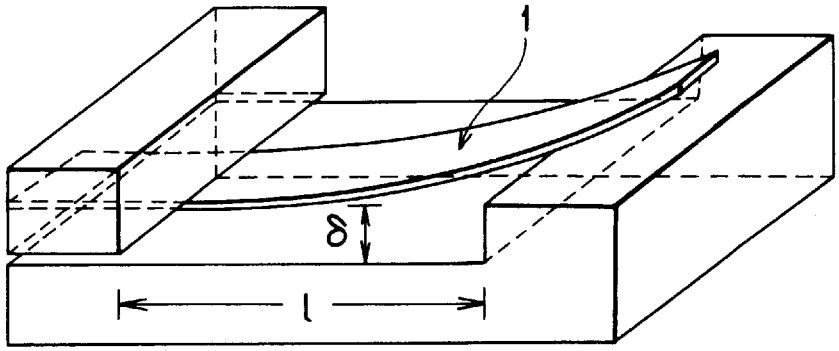
FIG. 1 is a schematic perspective view illustrating a method of assessing a stress relaxation rate characteristic.

The copper alloy of the invention, which is adapted for use as terminals and connectors, is described in detail.

First, the elements added to and their contents in the copper alloy are described, in which percent is by weight.

(Ni)

Ni is an element which forms a modulated structure when added to the alloy along with Sn and which improves strength and a stress relaxation resistance characteristic. However, where P co-exists and an compound of Ni and P is formed, for example, by batch annealing, the resultant modulated structure portion is reduced in amount, thereby leading to a considerable lowering of the stress relaxation resistance characteristic. Thus, a solid solution treatment is necessary. If the content is less than 0.1%, the above effects cannot be expected. On the other hand, when the content is 0.5% or over, electrical conductivity and a peeling off resistance of solder lowers, thus being poor in economy. Accordingly, the content of Ni ranges from 0.1 to less than 0.5%.

(Sn)

Sn forms a modulated structure when added in combination with Ni and brings about the effect of improving mechanical properties, balancing yield strength and elongation, and thus improving moldability, a spring limit value and a stress relaxation resistance characteristic. If the content is 1.0% or below, the effect is not expected. On the other hand, when the content is 2.5% or over, electrical conductivity lowers, thus being uneconomical. Accordingly, the content of Sn ranges from larger than 1.0% to less than 2.5%.

(Zn)

Zn is an essential element which is able to suppress migration of Cu and a leakage current in case where water or moisture enters and condenses between the pins of electric or electronic parts to which a voltage is applied. This element can improve strength and solder bonding properties and suppress the occurrence of whisker. When the content of Zn is not larger than 1.0 wt %, the improvement in the resistance to migration and the solder bonding properties along with the effect of suppressing the occurrence of whisker is lessened. On the contrary, when the content exceeds 15%, electrical conductivity lowers, and stress corrosion cracking is liable to occur. Accordingly, the content of Zn should exceed 1.0% but is not larger than 15%.

(P)

P is an element which contributes mainly to improvement in soundness of ingots (e.g. deoxidation, fluidity and the like).

When the content of P (i.e. an amount of P left in the alloy) is less than 0.0001%, a deoxidation effect in a molten metal cannot be expected. On the other hand, when P is added in an amount of 0.05% or over (particularly, 0.025% or over), Ni—P intermetallic compounds is readily precipitated and coagulated to cause grain growth depending on the manner of manufacture, thereby impeding mechanical properties, bendability or plating properties of the resultant alloy product. Even when a thermal treatment is performed within such a range that any Ni—P compound is not precipitated, the addition of P in an amount of 0.05% or over will cause a peeling off phenomenon of a solder and a Sn film and stress corrosion cracking takes place. Accordingly, the amount of P is in the range of not less than 0.0001% to less than 0.05%, and especially, with a Cu alloy which does not comprise any element other than Ni, Sn, Zn and P, the amount should preferably range from not less than 0.0001% to less than 0.025%, more preferably from 0.0001% to less than 0.01%.

(Si)

Si has an effect as a deoxidizer when added to at the time of melt forging. Accordingly, the addition of Si enables one to reduce a remaining amount of P which is apt to deteriorate material characteristics of a final product. Aside from the case where Si is added to as a deoxidizer, it has the effect of increasing a recrystallization temperature. In order to obtain these effects, it is preferred to leave O in an amount of 0.0001% or over.

On the other hand, a major proportion of Si added to the alloy is removed from a molten metal in the form of oxides formed after deoxidation. However, if Si left in the matrix as a solid solution component is present at a level of 0.05% or over, whitening or peeling of a solder and an Sn film is caused along with a lowering of electrical conductivity. Moreover, remaining Si suppresses the formation of the modulated structure. Accordingly, the content of Si is in the range of 0.05% or below, preferably from 0.0001% to less than 0.01%.

(Ti, Mg, Fe and Ag)

When added to in very small amounts, these elements have the effect of further improving a stress relaxation resistance characteristic. If these are each present in an amount less than 0.0001%, such an effect as mentioned above cannot be expected. If the total amount exceeds 1%, the electrical conductivity, peeling off resistance of solder and bend formability undesirably lower. Accordingly, the total amount should be in the range of from 0.0001% to 1%.

(S)

S is melted out at grain boundaries as a simple element at high temperatures or as a low melting point intermetallic compound or composite oxide, thus being a harmful element of deteriorating workability. If the content exceeds 0.005%, cracking at boundaries takes place from the low melting portions at the time of hot rolling, thereby causing the resultant ingot to be cracked. On the other hand, S is able to improve punching workability (e.g. a reduction in amount of burs and a reduction of a residual stress) when subjected to a punching press, thereby making it possible to reduce the wear of a punching mold. No or little effect is expected when the content is 0.0005% or below. Accordingly, the content of S is in the range of larger than 0.0005% to 0.005% or below.

(O, H)

The alloy of the invention absorbs H and O, which are each a gaseous element, at a molten stage thereof. These elements are expelled from the molten alloy at the time of solidification, so that if the contents of O and H are not controlled at levels of 50 ppm or below and 10 ppm or below, respectively, fluidity at the time of forging degrades along with a casting surface. Especially, when H remains, it may cause sheet surfaces to be blistered on the intermediate step of rolling or annealing although the alloy may be converted to a sheet material, thus impeding a value as a product. Thus, the content of O should be 50 ppm or below and that of H should be 10 ppm or below. The content of O can be controlled according to a procedure wherein an appropriate amount of P, Si, Mg, Ti or the like is added to the alloy to form a compound with O, or a gas, such as $N_2$ gas, is used in the melting atmosphere so as to intercept oxygen therewith.

(Other selective elements)

Ca, Mn, Be, Al, V, Cr, Co, Zr, Nb, Mo, In, Pb, Hf, Ta, B, Ge and Sb are, respectively, able to improve the stress relaxation resistance. If all of the elements are present in amounts of not larger than 1%, they do not form any intermetallic compounds with Ni and Sn which are main components in the alloy of the present invention. However, these elements have a low solubility-limit in the vicinity of normal temperatures or have strong affinity for oxygen. Accordingly, one or more of these elements are contained in total amounts exceeding 1%, coarse oxides may be formed or coarse grains may be formed at the time of melt forging or hot rolling or on the way of the thermo mechanical treatment, thus leading to a lowering of plating properties or bendability. In addition, electrical conductivity may also lower. Accordingly, the amount of one or more of these selective elements is 1% or below in total.

(Electrical conductivity)

We have found that precipitates in the copper alloy cause the stress relaxation resistance characteristic to be degraded, and have intended to form a solid solution of additive elements. In order to keep a stress relaxation rate at a level of 30% or below after 1000 hours at 160° C., it is necessary that an electrical conductivity be kept at 90% or below of a maximum electrical conductivity attained on annealing of a copper alloy. It will be noted that the maximum electrical conductivity obtained on annealing means one which is obtained by annealing a copper alloy under conditions of 500° C.×4 hours. With the copper alloy of the invention, the maximum electrical conductivity is obtained when the alloy is annealed at about 500° C. (over several tens of minutes or longer) and is saturated under annealing conditions of 500° C.×4 hours. This is because precipitates are formed in a maximum amount, so that there is little further increase in the electrical conductivity. It is to be noted that in order to attain such an electrical conductivity as defined above after stabilization annealing, it is necessary that a copper alloy have a defined electrical conductivity after annealing (prior to stabilization annealing) on the way of cold rolling.

The improvement in stress relaxation resistance characteristic of the copper alloy is realized for the first time by appropriately controlling a microscopic structure of the inside of grains which can be observed through a transmission electron microscope. More particularly, the stress relaxation resistance characteristic is remarkably improved by controlling the behavior of precipitates in the stabilization annealing performed after annealing on the way of cold rolling or after final cold rolling. The behavior of precipitates appears as a change of electrical conductivity. The electrical conductivity of a final product at the stabilization annealing which is not higher than 90% of a maximum electrical conductivity means that although a precipitate is formed to some extent during the course of annealing, substantially all of the additive elements are in a solid solution state so that a resistance (i.e. the action of blocking migration of slip bands or disappearance of dislocations) to stress relaxation of the matrix body is maintained. However, if the precipitates is formed in large amounts permitting an electrical conductivity to exceed 90%, the dislocations in the matrix disappear. Eventually, the material characteristics lower, and there cannot be obtained a satisfactory stress relaxation resistance characteristic.

It should be noted that in the copper alloy of the invention, an electrical conductivity at a level of 90 of a maximum value corresponds to an area ratio of insoluble matters, such as a precipitate, which is almost at 5% or below. The term "area ratio" used herein is intended to mean the ratio of precipitates per unit area. The term "insoluble matter" used herein is intended to mean such a precipitate as mentioned above, which is not completely solubilized in an alloy, and precipitates, such as $Ni_5P_2$, $P_2O_5$ and the like, settled during the course of an annealing step, with a size of several to several tens of micrometers.

(Measurement of stress relaxation rate)

With the case of terminals and connectors, as the stress relaxation resistance characteristic degrades, there arise troubles such as a lowering in fitting force between terminals, thus impeding reliability. However, no problem is involved when the stress relaxation rate obtained after 1000 hours at 160° C. is at 30% or below. In the copper alloy of the invention, when the electrical conductivity and the area ratio of precipitates, respectively, satisfy such requirements as set out before, it is possible to keep the stress relaxation rate after a lapse of 1000 hours at 160° C. at 30% or below.

The alloy of the invention primarily aims at the improvement of a stress relaxation resistance characteristic, so that it is necessary to recrystallize the alloy on the way of cold rolling after hot rolling wherein the greatest elastic strain energy is stored prior to final cold rolling. In order to keep the electrical conductivity at 90% or below after stabilization annealing, the conductivity at a stage after annealing on the way of cold rolling should be 90% or below. For conventional precipitation hardened alloys, it is essential to perform batchwise annealing, whereas in the practice of the invention, an alloy composition is properly controlled and the annealing is effected within a short time, thereby imparting an intended electrical conductivity to the alloy. Specific thermal treating conditions for the recrystallization are as follows: the alloy of the invention is not of the precipitation hardening type, so that the recrystallization is carried out under heating conditions of 250 to 850° C., preferably 550° C. to 650° C. for a time of 5 seconds to 1 minute. If lower temperatures or shorter times are used, there cannot be obtained a completely recrystallized structure. On the other hand, if higher temperatures or longer times are used, grain growth of precipitates proceeds excessively, resulting in an undesirably great area ratio. This invites an increased electrical conductivity with a lowering of the stress relaxation resistance characteristic. Moreover, since the grain size becomes larger, mechanical properties degrade.

On the other hand, after final rolling, it is necessary to effect stabilization annealing in order to further improve the stress relaxation resistance characteristic and material characteristics (especially, a limit value as a spring). To this end, the stabilization annealing should be effected within a temperature range of 250 to 850° C., preferably 300 to 450° C., for a time of 5 seconds to 1 minute. If lower temperatures or shorter times than the above-defined ranges are used, the dislocation introduced during cold rolling is not appropriately released, thereby not improving the stress relaxation resistance characteristic and the material characteristics. On the contrary, when higher temperatures or longer times than the above defined-ranges are used, grain growth of precipitates proceeds excessively, resulting in an increased area ratio. This undesirably increases an electrical conductivity, raises an electrical conductivity and lowers the stress relaxation resistance characteristic, thus being inconvenient from the standpoint of economy.

The invention is more particularly described by way of examples wherein in Example 1, whether or not a sheet material can be fabricated is checked, in Example 2, the influences of additive elements are checked, and in Example 3, the effects of electrical conductivity and area ratio of precipitates and thermal treating conditions are checked.

EXAMPLE 1

Copper alloys were melted in a kryptol furnace in air under coverage with char coal to obtain ingots having the formulations indicated in Table 1. At this stage, whether or not forging was possible was judged. Subsequently, individual ingots were hot rolled into 15 mm thick sheets, followed by judging the occurrence of cracks at the time of the hot rolling through visual observation.

It will be noted that the copper alloys of the invention could be made through horizontal continuous forging which did not require any hot rolling.

TABLE 1

| No. | Ni | Sn | Zn | P | Si | Ti | Mg | Fe | Ag | S | H * | O * | Cu | Selective Elements |
|---|---|---|---|---|---|---|---|---|---|---|---|---|---|---|
| | Chemical Components (wt % ppm for the mark "*") | | | | | | | | | | | | | |
| Inventive Example | | | | | | | | | | | | | | |
| 1 | 0.11 | 1.51 | 1.51 | 0.008 | 0.005 | 0.005 | 0.02 | 0.002 | 0.002 | 0.0015 | 1.9 | 22 | residue | Ca, Mn, Be, Al: 0.0001 for each element |
| 2 | 0.49 | 1.47 | 1.52 | 0.010 | 0.004 | 0.005 | 0.02 | 0.005 | 0.003 | 0.0023 | 1.9 | 23 | residue | V, Cr, Zr, Co: 0.0001 for each element |
| 3 | 0.41 | 1.11 | 1.31 | 0.005 | 0.005 | 0.004 | 0.02 | 0.001 | 0.003 | 0.0023 | 1.5 | 24 | residue | Nb, Mo, Zr, In: 0.0001 for each element |
| 4 | 0.44 | 2.42 | 1.11 | 0.008 | 0.004 | 0.005 | 0.015 | 0.0011 | 0.003 | 0.0041 | 1.4 | 23 | residue | Pb, Hf, Ta, B: 0.0001 for each element |
| 5 | 0.43 | 1.54 | 9.40 | 0 | 0.005 | 0.005 | 0.02 | 0.003 | 0.001 | 0.0035 | 1.4 | 25 | residue | not added |
| 6 | 0.41 | 1.55 | 1.33 | 0.0003 | 0.0003 | 0.005 | 0.016 | 0.004 | 0.002 | 0.0033 | 1.5 | 24 | residue | Ca, Mn: 0.005 for each element |
| 7 | 0.43 | 1.51 | 1.55 | 0.044 | 0.047 | 0.007 | 0.005 | 0.003 | 0.002 | 0.0013 | 1 .5 | 23 | residue | Be, Al: 0.005 for each element |
| 8 | 0.41 | 1.52 | 1.34 | 0.011 | 0.002 | 0.006 | 0.006 | 0.009 | 0.002 | 0.0014 | 1.3 | 22 | residue | Cr, Zr: 0.005 for each element |
| 9 | 0.41 | 1.54 | 1.55 | 0 | — | — | — | — | — | 0.0012 | 1.3 | 21 | residue | not added |
| 10 | 0.37 | 1.54 | 1.54 | 0.032 | 0.011 | 0.06 | 0.08 | 0.58 | 0.001 | 0.0014 | 1.5 | 23 | residue | Mo, B: 0.005 for each element |
| 11 | 0.44 | 1.5 | 1.34 | 0.00003 | 0.01 | 0.002 | 0.008 | 0.003 | 0.003 | 0.0015 | 1.4 | 21 | residue | Ca, Mn: 0.0001 for each element |
| Comparative Example | | | | | | | | | | | | | | |
| 12 | 0.43 | 1.54 | 1.44 | 0.00003 | 0.00003 | 0.004 | 0 | 0.005 | 0.001 | 0.0013 | 1.4 | 22 | residue | Mn, In: 0.003 for each element |
| 13 | 0.43 | 1.58 | 1.54 | 0.004 | 0.006 | 0.005 | 0.005 | 0.006 | 0.003 | 0.0022 | 25 | 55 | residue | not added |
| 14 | 0.44 | 1.57 | 1.44 | 0.005 | 0.008 | 0.005 | 0.007 | 0.008 | 0.004 | 0.012 | 1.4 | 23 | residue | Ca, Pb, Sb: 0.005 for each element |

From the above results, the alloys of Inventive Example Nos. 1 to 11 were all capable of being forged and suffered no crack at the time of the hot rolling. On the other hand, the alloy of Comparative Example No. 12 was short of P and Si, so that there could not be obtained a sound ingot owing to the insufficiency of deoxidation. In Comparative Example No. 13, H and O were both in excess, so that fluidity lowered extremely, thereby stopping forging. The alloy of Comparative Example No. 14 was able to be forged, but S was contained in excess, so that the alloy was cracked at the time of the hot rolling.

EXAMPLE 2

The copper alloys of the comparative example were each melted in a kryptol furnace in air under coverage with char coal to obtain ingots having the formulation indicated as Nos. 15 to 28 in Table 2, followed by hot rolling into 15 mm thick sheets. Because the alloys for comparison had S, H and O contained in the defined ranges, respectively, good hot rolled sheets were readily obtained.

The hot rolled sheets (having a thickness of 15 mm) of Inventive Example Nos. 1 to 11 and Comparative Example Nos. 15 to 28 were subjected to the combination of cold rolling and thermal treatment under conditions indicated below to obtain 0.25 mm thick sheet materials. (Nos. 1 to 11, 15 to 25 and 28) 15 mm thick sheet→cold rolled to 0.5 mm thickness→annealed under conditions of 600° C.×20 seconds→cold rolled to 0.25 mm thickness→annealed for stabilization under conditions of 300° C.×20 seconds (No. 26) 15 mm thick sheet→cold rolled to 0.5 mm thickness→annealed under conditions of 550° C.×2 hours→cold rolled to 1.5 mm thickness→annealed conditions of 450° C.×2 hours→cold rolled to 0.34 mm thickness→annealed under conditions of 400° C.×2 hours→cold rolled to 0.25 mm thickness→annealed for stabilization under conditions of 350° C.×20 seconds (No. 27) 15 mm thick sheet→cold rolled to 3.0 mm thickness→annealed under conditions of 490° C.×2 hours→cold rolled to 1.0 mm thickness→annealed conditions of 360° C.×2 hours cold rolled to 0.25 mm thickness→annealed for stabilization under conditions of 350° C.×20 seconds These sheet materials were subjected to evaluation of material characteristics in the following manner to confirm differences with those for comparison.

TABLE 2

| No. | Ni | Sn | Zn | P | Si | Ti | Mg | Fe | Ag | S | H * | O * | Cu | Selective Elements |
|---|---|---|---|---|---|---|---|---|---|---|---|---|---|---|
| | Chemical Components (wt %, ppm for the mark "*") | | | | | | | | | | | | | |
| Comparative Example | | | | | | | | | | | | | | |
| 15 | 0.65 | 1.23 | 1.44 | 0.012 | 0.003 | 0.002 | 0.006 | 0.003 | 0.003 | 0.0012 | 1.4 | 21 | residue | Ca, Mn, Be, Al: 0.0001 for each element |

TABLE 2-continued

| | Chemical Components (wt %, ppm for the mark "*") | | | | | | | | | | | | | |
|---|---|---|---|---|---|---|---|---|---|---|---|---|---|---|
| No. | Ni | Sn | Zn | P | Si | Ti | Mg | Fe | Ag | S | H * | O * | Cu | Selective Elements |
| 16 | 0.04 | 1.32 | 1.34 | 0.011 | 0.003 | 0.002 | 0.005 | 0.005 | 0.004 | 0.0012 | 1.4 | 21 | residue | V, Cr, Zr, Co: 0.0001 for each element |
| 17 | 0.34 | 3.11 | 1.45 | 0.031 | 0.006 | 0.005 | 0.006 | 0.021 | 0.002 | 0.00#2 | 1.3 | 23 | residue | Nb, Mo, Zr, In: 0.0001 for each element |
| 18 | 0.32 | 0.43 | 1.67 | 0.023 | 0.008 | 0.003 | 0.004 | 0.012 | 0.002 | 0.0011 | 1.5 | 23 | residue | Pb, Hf, Ta, B: 0.0001 for each element |
| 19 | 0.45 | 1.44 | 18.0 | 0.003 | 0.011 | 0.007 | 0.006 | 0.013 | 0.003 | 0.0012 | 1.5 | 24 | residue | not added |
| 20 | 0.43 | 1.45 | 0.43 | 0.021 | 0.008 | 0.005 | 0.006 | 0.016 | 0.004 | 0.0014 | 1.4 | 24 | residue | Ca, Mn: 0.005 for each element |
| 21 | 0.34 | 1.54 | 1.89 | 0.11 | 0.007 | 0.004 | 0.007 | 0.012 | 0.002 | 0.0014 | 1.4 | 25 | residue | Be, Al: 0.005 for each element |
| 22 | 0.45 | 1.56 | 1.56 | 0.023 | 0.12 | 0.004 | 0.006 | 0.022 | 0.003 | 0.0015 | t.6 | 24 | residue | Cr, Zr: 0.005 for each element |
| 23 | 0.43 | 1.34 | 1.67 | 0.011 | 0.007 | 0.011 | 0.02 | 1.00 | 0.002 | 0.0012 | 1.7 | 23 | residue | Co, Mo: 0.005 for each element |
| 24 | 0.34 | 1.45 | 1.45 | 0.012 | 0.008 | 0.10 | 0.50 | 0.23 | 0.05 | 0.0012 | 1.4 | 22 | residue | Mo, B: 0.005 for each element |
| 25 | 0.22 | 1.45 | 1.55 | 0.031 | 0.011 | 0.006 | 0.005 | 0.011 | 0.003 | 0.0014 | 1.4 | 21 | residue | Mn: 0.3, Al: 0.3, Zr: 0.3 Cr: 0.1, Mo: 0.1, Pb: 0.1 Ge: 0.01, Sb: 0.01 |
| 26 | — | 6.02 | — | 0.032 | — | — | — | — | — | — | 1.5 | 24 | residue | not added |
| 27 | — | — | 30.0 | — | — | — | — | — | — | — | 1.6 | 22 | residue | not added |
| 28 | 0.43 | 1.51 | 1.34 | 0.15 | 0.14 | 0.003 | 0.005 | 0.005 | 0.004 | 0.0012 | 1.4 | 21 | residue | V, Cr: 0.0001 for each element |

(Mechanical strength)

The yield strength and tensile strength were, respectively, measured using JIS No. 5 test pieces (n=2) whose lengthwise direction was in parallel to a rolling direction.

(Stress relaxation characteristic)

Figure 2:
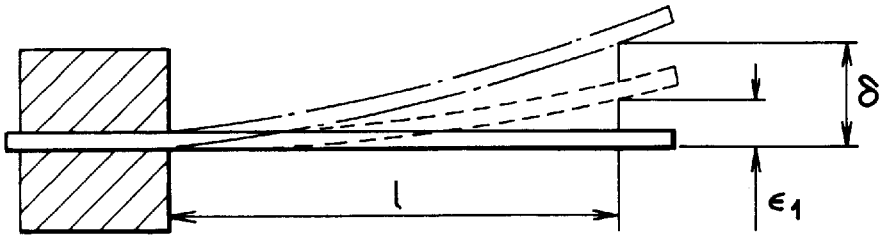
FIG. 2 is a schematic side view showing a measuring device used in FIG. 1.

As is particularly shown in FIGS. 1 and 2, a 10 mm wide test piece 1 was fixed with a cantilever in a manner described in EMA-3003 and exerted with a bending stress corresponding to 80% of a yield strength of the test piece at a position corresponding to a length of 80 mm indicated as (1). Under exerted conditions, the test piece was kept at 160° C. or 180° C. for 1000 hours, followed by removal of the stress. The quantity (δ) of deflection of the test piece at the exerted point and the quantity of displacement (ϵ1) after the removal of the stress were, respectively, measured, followed by calculation of a stress relaxation rate according to the following equation (n=5 for the respective temperatures) Stress relaxation rate (%)=(ϵ1/δ)×100

It will be noted that the bending stress (σ) was calculated according to the following equation $$\sigma=(3\times E\times t\times\delta)/(2\times 1^2)$$

wherein

σ: bending stress=yield strength of a test piece×0.8,

E: young modulus of a test piece ($N/mm^2$), and

T: sheet thickness of a test piece=0.25.

(Electrical conductivity)

The electrical conductance was evaluated by measuring an electrical conductivity. The electrical conductivity was measured based on the method described in JIS H 0505.

(Peeling off resistance of solder)

Based on the procedure of MIL-STD-202F Method 208D, soldering was performed. Thereafter, after a lapse of 1000 hours at 150° C. in air, a soldered test piece was bent at 1800 at a curvature of 1 mm ϕ while turning the solder up, followed by confirming whether the solder was peeled off or not through visual observation(n=3). In the evaluation through the visual observation, the case where it was confirmed that the solder was separate from a test piece or matrix was judged as peeled.

(Migration resistance)

Figure 3:
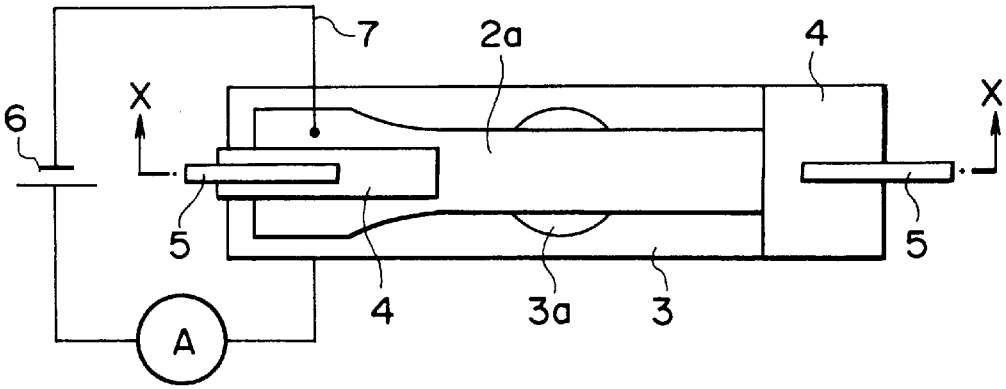
FIG. 3 is a schematic plan view illustrating a method of measuring a maximum leakage current.
Figure 4:
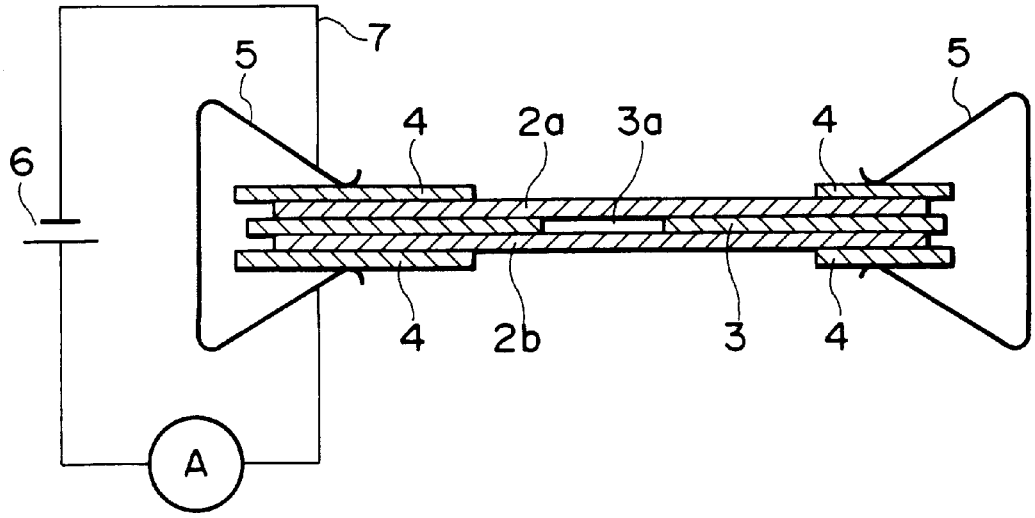
FIG. 4 is a schematic side view showing a measuring device used in FIG. 3.

Test pieces having a width of 3.0 mm and a length of 80 mm were sampled from each sheet material, and a migration resistance test was carried out using two pieces in combination (n=4). FIGS. 3 and 4, respectively, illustrate a test method of measuring a leakage current of the test pieces. In FIGS. 3 and 4, indicated at 2*a*, 2*b* are, respectively, test pieces, at 3 is a 1 mm thick ABS resin sheet, at 3*a* is a hole formed in the ABS sheet, and at 4 is a keep plate for the ABS resin sheet. Also indicated at 5 is a clip for urgedly fixing the keep plate, which is coated on the surfaces thereof with an insulating paint, at 6 is a battery, and at 7 is an electric wire. The test pieces 2*a*, 2*b* are connected with the electric wire 7 at end portions thereof.

A direct current at 14 V is applied from the battery 6 to two test pieces 2*a*, 2*b* shown in FIGS. 3 and 4, followed by immersion in city water for 5 minutes, drying for 10 minutes and repeating this cycle 50 times. A maximum leakage current during the repetition is measured by means of a high sensitivity recorder (not shown).

(Bendability)

A test piece processed to have a width of 10 mm and a length of 35 mm was sandwiched between the B-type bending tools defined in the CESM0002 metal material W-bending test, and subjected to W-bending at R/t of 0 under a load of 1 ton by use of as a universal testing machine RH-30, made by Shimadzu Corporation. Subsequently, the test piece was subjected to 180 degree bending at 0 radius at the portion bent at 90° under a load of 1 ton, followed by checking the presence or absence of cracks at the bent portion (n=2). The degree of cracking at the bent portion was assessed according to a five-rank evaluation on bendability defined by the JAPAN COPPER AND BRASS RESEARCH ASSOCIATION as follows.

A: no wrinkle, B: small wrinkles, C: wrinkles, D small cracks, E: cracks

In the practice of the invention, those samples evaluated as A to C were assessed as good, and those samples evaluated as D and E were assessed as cracked.

(Resistance to stress corrosion crack)

Figure 5:
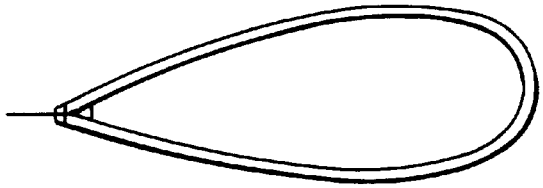
FIG. 5 is a schematic view showing a looped test piece used in a stress corrosion crack resistance.

0.25 mm thick×12.7 mm wide×150 mm long test pieces were cut off from each sheet material and subjected to a resistance to stress corrosion crack according the Thompson method (Materials Research & Standards (1961) 1081) (n=4). More particularly, the test piece was formed in a loop as shown in FIG. 5, after which aqueous 14% ammonia was placed in a desiccator. The desiccator was filled with a saturated ammonia vapor at a temperature of 40° C., followed by exposure of the loop to the vapor to measure a time before the test piece was broken down.

The results of these measurements are shown in Tables 3 and 4.

TABLE 3

| | Results of measurements | | | | | | | | |
|---|---|---|---|---|---|---|---|---|---|
| | Yield Strength | Tensile Strength | Conductivity at 0 radius | Electrical Bendability at 180° | Resistance to Migration* | Peeling off resistance of | Stress Relaxation Rate %*** | | Resistance to Stress Corrosion Crack**** |
| No. | N/mm$^2$ | N/mm$^2$ | % IACS | Bending | A | solder** | 160° C. | 180° C. | hr |
| Inventive Example | | | | | | | | | |
| 1 | 530 | 565 | 40 | good | 0.4 | good | 25 | 35 | 100 |
| 2 | 550 | 585 | 39 | good | 0.4 | good | 20 | 33 | 100 |
| 3 | 545 | 580 | 39 | good | 0.4 | good | 20 | 33 | 100 |
| 4 | 560 | 595 | 37 | good | 0.5 | good | 15 | 28 | 100 |
| 5 | 585 | 605 | 33 | good | 0.3 | good | 25 | 32 | 60 |
| 6 | 550 | 580 | 37 | good | 0.4 | good | 15 | 27 | 100 |
| 7 | 550 | 580 | 37 | good | 0.4 | good | 20 | 31 | 80 |
| 8 | 545 | 575 | 37 | good | 0.4 | good | 20 | 32 | 100 |
| 9 | 550 | 580 | 37 | good | 0.4 | good | 20 | 33 | 90 |
| 10 | 565 | 600 | 37 | good | 0.4 | good | 15 | 27 | 90 |
| 11 | 550 | 581 | 35 | good | 0.4 | good | 15 | 28 | 100 |

*Maximum leakage current
**After 1000 hours × 160° C.,
***Percent after 1000 hours,
****Time before breakage

TABLE 4

| | Results of measurements | | | | | | | | |
|---|---|---|---|---|---|---|---|---|---|
| | Yield Strength | Tensile Strength | Conductivity at 0 radius | Electrical Bendability at 180° | Resistance to Migration* | Peeling off resistance of | Stress Relaxation Rate %*** | | Resistance to Stress Corrosion Crack**** |
| No. | N/mm$^2$ | N/mm$^2$ | % IACS | Bending | A | solder** | 160° C. | 180° C. | hr |
| Comparative Example | | | | | | | | | |
| 15 | 575 | 605 | 34 | good | 0.4 | peeled off | 20 | 33 | 100 |
| 16 | 465 | 480 | 44 | good | 0.5 | good | 40 | 48 | 110 |
| 17 | 590 | 620 | 33 | cracked | 0.4 | good | 20 | 35 | 100 |
| 18 | 470 | 500 | 39 | good | 0.4 | good | 40 | 52 | 100 |
| 19 | 590 | 620 | 23 | good | 0.3 | good | 45 | 58 | 5 |
| 20 | 530 | 565 | 40 | good | 2.8 | peeled off | 25 | 33 | 100 |
| 21 | 560 | 590 | 32 | good | 0.4 | peeled off | 25 | 34 | 20 |
| 22 | 560 | 590 | 39 | good | 0.4 | peeled off | 25 | 33 | 100 |
| 23 | 550 | 585 | 24 | cracked | 0.4 | peeled off | 25 | 33 | 100 |
| 24 | 550 | 580 | 33 | cracked | 0.4 | peeled off | 25 | 32 | 100 |
| 25 | 545 | 560 | 30 | cracked | 0.4 | good | 25 | 32 | 100 |
| 26 | 640 | 675 | 14 | cracked | 3.2 | peeled off | 50 | 62 | 20 |
| 27 | 620 | 650 | 27 | cracked | 0.3 | good | 55 | 68 | 0.5 |
| 28 | 560 | 593 | 28 | good | 0.4 | peeled off | 26 | 35 | 15 |

*Maximum leakage current,
**After 1000 hours × 160° C.,
***Percent after 1000 hours,
****Time before breakage As shown in Table 3, the alloys of the invention exhibit good yield strength, electrical conductivity and bendability determined by 180° bending at 0 radius, with the maximum leakage current value in the migration resistance being suppressed at a low level. Moreover, the inventive alloys have a good thermal peel resistance and a good resistance to stress corrosion crack, along with an excellent stress relaxation resistance characteristic.

On the other hand, the alloy of Comparative Example 15 contains Ni in excess, the electrical conductivity is low and peeling takes place in the soldering heat resistance test. Comparative Example 16 is short of the Ni content, so that the yield strength is low and the stress relaxation resistance characteristic is poor.

In Comparative Example 17, Sn is contained in excess, so that the electrical conductivity becomes low and the stress relaxation resistance characteristic is poor. Further, breakage of the samples suffered within a short time was confirmed when the samples were subjected to a stress corrosion crack resistance test. Comparative Example 18 is short of the Sn content, so that the sufficient yield strength is not obtained, and the stress relaxation resistance characteristic is also poor.

In Comparative Example 19, Zn is added in excess, so that resultant alloy is low in electrical conductivity, is poor in the stress relaxation resistance characteristic, and suffers breakage within a short time in the stress corrosion crack resistance test. In Comparative Example 20, the content of Zn is in shortage, so that peeling is observed in the soldering heat resistance test along with a leakage current being high when determined by the migration resistance test, thus being vital for use as automotive terminals.

In Comparative Example 21, P is added to in excess, so that peeling takes place in the soldering heat resistance test and the stress relaxation resistance characteristic is poor. In Comparative Example 22, Si is added to in excess, peeling takes place in the soldering heat resistance test.

In Comparative Example 23, Fe is added to in excess, the electrical conductivity lowers, and the samples suffer cracks when determined by the bendability test, and peeling takes place in the soldering heat resistance test. In Comparative Example 24, Mg is added to in excess, cracks occur in the bendability test, and peeling takes place in the soldering heat resistance test. Comparative Example 25 deals with selective elements, such as Mn, whose total amount is in excess, so that cracks are formed in the bendability test and peeling takes place in the soldering heat resistance test.

Comparative Example 26 deals with phosphor bronze wherein the resultant alloy is low in electrical conductivity, suffers cracks when subjected to the bendability test, is poor in the migration resistance and the stress relaxation resistance characteristic, and involves peeling in the soldering heat resistance test. In Comparative Example 27, bronze is used, resulting in a low electrical conductivity, the occurrence of cracks in the bendability test, a poor stress relaxation resistance characteristic, and the breakage within a short time in the stress corrosion crack resistance test. In Comparative Example 28, P and Si are added to in excess, so that peeling takes place in the soldering heat resistance.

EXAMPLE 3

The hot-rolled sheet (15 mm in thickness) having composition No. 2 indicated in Table 1 was subjected to the combination of cold rolling and annealing under different conditions indicated in Table 5 to obtain 0.25 mm thick sheets. The thus obtained sheets were subjected to measurements of material characteristics and an area ratio of precipitates in the following manner.

(Area ratio of precipitates)

A ratio of precipitates per unit area was determined by use of TEM through observation of three visual views at magnifications of 90,000 (which were the most favorable magnifications for confirming precipitates), with an average value of such ratios being provided as an area ratio.

TABLE 5

| | Treating procedures and conditions | |
|---|---|---|
| | No. | Procedure |
| Inventive Example | 2-1 | rolled to 0.83 mm thickness→annealed under 250° C. × 5 seeonds→ cold rolled by 70% to 0.25 mm thickness→annealed under 400° C. × 20 seeonds |
| | 2-2 | rolled to 0.63 mm thickness→annealed under 850° C. × 1 minute→ cold rolled by 60% to 0.25 mm thickness→annealed under 400° C. × 20 seconds |
| | 2-3 | rolled to 0.50 mm thickness→annealed under 600° C. × 5 seconds→ cold rolled by 50% to 0.25 mm thickness→annealed under 400° C. × 20 seconds |
| Comparative Example | 2-4 | rolled to 0.50 mm thickness→annealed under 250° C. × 3 seconds→ cold rolled by 50% to 0.25 mm thickness→annealed under 400° C. × 20 seconds |
| | 2-5 | rolled to 0.50 mm thickness→annealed under 850° C. × 5 minutes→ cold rolled hy 50% to 0.25 mm thickness→annealed under 400° C. × 20 seconds |
| | 2-6 | rolled to 0.50 mm thickness→annealed under 600° C. × 3 seconds→ cold rolled by 50% to 0.25 mm thickness→annealed under 400° C. × 20 seconds |
| | 2-7 | rolled to 0.50 mm thickness→annealed under 600° C. × 5 minutes→ cold rolled by 50% to 0.25 mm thickness→annealed under 400° C. × 20 seconds |
| | 2-8 | rolled to 0.50 mm thickness→annealed under 200° C. × 20 seconds→ cold rolled by 50% to 0.25 mm thickness→annealed under 400° C. × 20 seconds |
| | 2-9 | rolled to 0.50 mm thickness→annealed under 900° C. × 20 seconds→ cold rolled by 50% to 0.25 mm thickness→annealed under 400° C. × 20 seconds |
| | 2-10 | rolled to 0.50 mm thickness→annealed under 600° C. × 20 seconds→ cold rolled by 50% to 0.25 mm thickness |
| | 2-11 | rolled to 0.50 mm thickness→annealed under 600° C. × 20 seconds→ cold rolled by 50% to 0.25 mm thickness→annealed under 250° C. × 3 seconds |
| | 2-12 | rolled to 0.50 mm thickness→annealed under 800° C. × 20 seconds→ cold rolled by 50% to 0.25 mm thickness→annealed under 850° C. × 5 minutes |
| | 2-13 | rolled to 0.50 mm thickness→annealed under 600° C. × 20 seconds→ cold rolled by 50% to 0.25 mm thickness→annealed under 400° C. × 3 seconds |
| | 2-14 | rolled to 0.50 mm thickness→annealed under 600° C. × 20 seconds→ cold rolled by 50% to 0.25 mm thickness→annealed under 400° C. × 5 minutes |
| | 2-15 | rolled to 0.50 mm thickness→annealed under 600° C. × 20 seconds→ cold rolled by 50% to 0.25 mm thickness→annealed under 200° C. × 20 seconds |
| | 2-16 | rolled to 0.50 mm thickness→annealed under 600° C. × 20 seconds→ cold rolled by 50% to 0.25 mm thickness→annealed under 900° C. × 20 minutes rolled to 0.50 mm thickness→annealed under 500° C. × 4 hours→ |
| | 2-17 | cold rolled by 50% to 0.25 mm thickness |

Figure 6:
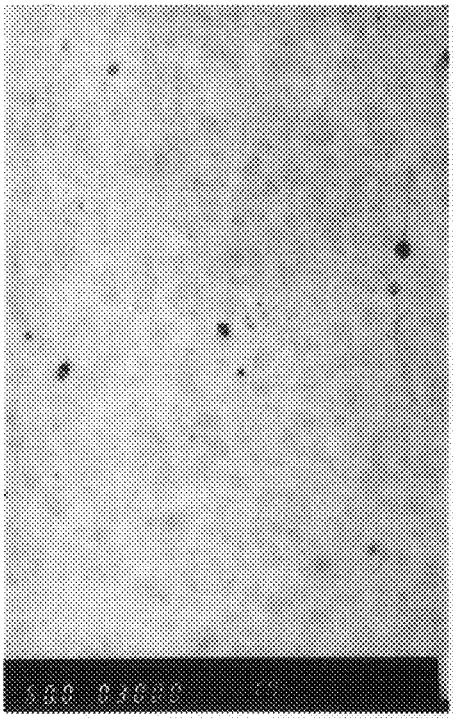
FIG. 6 is a metallographic photograph of a hot-rolled member of inventive alloy No. 2 obtained in Example, which has been cold-rolled and annealed at 600° C. for 20 seconds.
Figure 7:
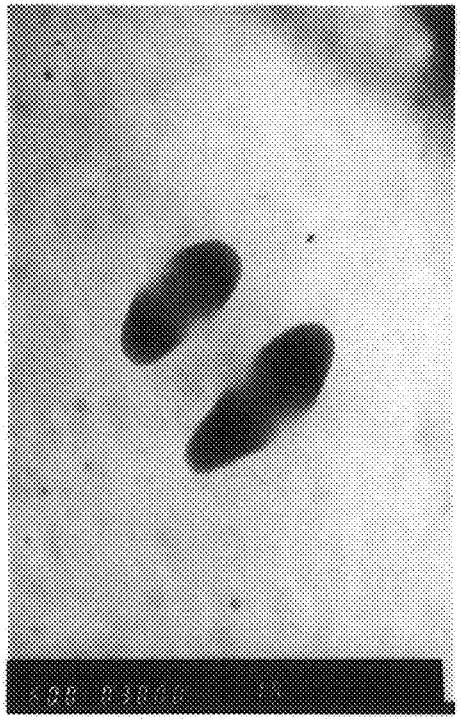
FIG. 7 is a metallographic photograph of a hot-rolled member of inventive alloy No. 2 obtained in Example, which has been cold-rolled and annealed at 500° C. for 4 hours.

The results of the measurements are shown in Tables 6 and 7. It will be noted that TEM photographs (with magnifications of 90,000) of structures after completion of the intermediate annealing in Inventive example 2-3 and Comparative Example 2-17 are, respectively, shown in Figs. 6 and 7.

TABLE 6

| | | | | | Results of Measurements | | | | | | |
|---|---|---|---|---|---|---|---|---|---|---|---|
| | | | | | Electrical Conductivity | | | | | | Stress |
| No. | Area Ratio of Precipitant % | Grain size μm | Yield Strength N/mm² | Tensile Strength N/mm² | % IACS | Ratio to Batch-annealed Alloy | Bendability at 180 Degree Bending at 0 Radius | Migration Resistance* A | Stress Relaxation rate %** 160° C. | 180° C. | Corrosion Crack Resistance*** hr |
| Inventive Example | | | | | | | | | | | |
| 2-1 | 1 | 5 | 590 | 600 | 37 | 82 | good | 0.4 | 23 | 32 | 100 |
| 2-2 | 5 | 15 | 555 | 575 | 39 | 87 | good | 0.4 | 25 | 35 | 100 |
| 2-3 | 2 | 10 | 550 | 575 | 38 | 84 | good | 0.4 | 20 | 28 | 100 |

*Maximum leakage current
**% after 1000 hours
***Time before Breakage

TABLE 7

| | | | | | Results of Measurements | | | | | | |
|---|---|---|---|---|---|---|---|---|---|---|---|
| | | | | | Electrical Conductivity | | | | | | Stress |
| No. | Area Ratio of Precipitant % | Grain size μm | Yield Strength N/mm² | Tensile Strength N/mm² | % IACS | Ratio to Batch-annealed Alloy | Bendability at 180 Degree Bending at 0 Radius | Migration Resistance* A | Stress Relaxation rate %** 160° C. | 180° C. | Corrosion Crack Resistance*** hr |
| Comparative Example | | | | | | | | | | | |
| 2-4 | 3 | Not recrystallized | 620 | 625 | 22 | 49 | cracked | 0.4 | 45 | 57 | 80 |
| 2-5 | 23 | 35 | 500 | 520 | 43 | 96 | cracked | 0.4 | 43 | 51 | 100 |
| 2-6 | 3 | Not recrystallized | 600 | 605 | 26 | 58 | cracked | 0.4 | 41 | 49 | 90 |
| 2-7 | 20 | 32 | 520 | 540 | 42 | 93 | cracked | 0.4 | 40 | 50 | 100 |
| 2-8 | 2 | Not recrystallized | 610 | 615 | 23 | 51 | cracked | 0.4 | 44 | 52 | 80 |
| 2-9 | 25 | 35 | 500 | 520 | 43 | 96 | cracked | 0.4 | 42 | 52 | 100 |
| 2-10 | 5 | 15 | 620 | 635 | 34 | 76 | cracked | 0.4 | 40 | 51 | 90 |
| 2-11 | 5 | 17 | 600 | 610 | 36 | 80 | cracked | 0.4 | 38 | 46 | 100 |
| 2-12 | 20 | 20 | 420 | 520 | 42 | 93 | good | 0.4 | 38 | 44 | 100 |
| 2-13 | 5 | 17 | 590 | 600 | 38 | 84 | cracked | 0.4 | 37 | 45 | 100 |
| 2-14 | 20 | 20 | 540 | 560 | 41 | 91 | good | 0.4 | 37 | 42 | 100 |
| 2-15 | 5 | 15 | 620 | 625 | 34 | 76 | cracked | 0.4 | 40 | 50 | 90 |
| 2-16 | 30 | 20 | 400 | 510 | 42 | 96 | good | 0.4 | 45 | 49 | 110 |
| 2-17 | 35 | 35 | 520 | 530 | 45 | 100 | cracked | 0.4 | 50 | 62 | 110 |

*Maximum leakage current
**% after 1000 hours
***Time before Breakage

As shown in Table 6, the alloys of Inventive Examples 2-1 to 2-3 exhibit good yield strength, electrical conductivity and bendability, and the maximum leakage current determined through the migration resistance is suppressed to a low level, along with good soldering heat resistance and stress corrosion crack resistance. Moreover, the electrical conductivity is not higher than 90% of the batch-annealed alloys (Comparative Example 2-17), and an area ratio of precipitates is 5% or below, thus being excellent in the stress relaxation resistance characteristic.

On the other hand, as shown in Table 7, Comparative Example 2-4 is so short in thermal treating time on the way of the cold rolling that no re-crystallization takes place, thus being poor in material characteristics including the stress relaxation resistance characteristic. In Comparative Example 2-5, the thermal treating time on the way of the cold rolling is so long that grain growth proceeds in excess. This leads to an excess area ratio of precipitates and an electric conductivity, which exceeds 90% of that of the batch-annealed alloy, along with poor stress relaxation resistance characteristic and bendability. In Comparative Example 2-6, the thermal treating time on the way of the cold rolling is so short that no re-crystallization takes place, thus the alloy being poor in characteristics including the stress relaxation resistance characteristic. In Comparative Example 2-7, the thermal treating time on the way of the cold rolling is so long that grain growth proceeds in excess, resulting in an excess area ratio of precipitates. Moreover, the electrical conductivity exceeds 90% of that of the batch-annealed alloy, the stress relaxation resistance characteristic degrades, and the bendability is poor.

In Comparative Example 2-8, the thermal treating temperature on the way of the cold rolling is so low that the resultant alloy is not re-crystallized and is poor in material characteristics including the stress relaxation resistance characteristic. In Comparative Example 2-9, the thermal treating temperatures on the way of the cold rolling is so high that grain growth proceeds in excess, resulting in an excess area ratio of precipitates. In addition, the electrical conductivity exceeds 90% of that of the batch-annealed alloy, and the stress relaxation resistance characteristic degrades along with poor bendability.

In Comparative Example 2-10, because stabilization annealing after the final rolling is not performed, dislocation is not properly released, thus resulting in a poor stress relaxation resistance characteristic. In Comparative Example 2-11, the annealing time after the final rolling is so short that dislocation is not properly released, resulting in a poor stress relaxation resistance characteristic. In Comparative Example 2-12, the annealing time after the final rolling is so long that precipitates grow in excess, resulting in an undesirably large area ratio. Additionally, the electrical conductivity exceeds 90% of that of the batch-annealed alloy along with a poor stress relaxation resistance characteristic. In Comparative Example 2-13, the annealing time after the final rolling is so short that dislocation is not properly released, resulting in a poor stress relaxation resistance characteristic. In Comparative Example 2-14, the annealing time after the final rolling is so long that precipitates grow in excess with a large area ratio, and the electrical conductivity is 90% or over of that of the batch-annealed alloy along with a poor stress relaxation resistance characteristic.

In Comparative Example 2-15, the annealing temperature after the final rolling is so low that dislocation is not properly released, resulting in a poor stress relaxation resistance characteristic. In Comparative Example 2-16, the annealing temperature after the final rolling is so high that precipitates grow in excess, resulting in a large area ratio. In addition, the electrical conductivity becomes 90% or over of that of the batch-annealed alloy with a poor stress relaxation resistance characteristic.

Comparative Examples 2-17 deals with a batch-annealed alloy, in which the annealing time on the way of the cold rolling exceeds the range defined in the present invention and the annealing after the final rolling is not performed. Thus, the resultant alloy is poor in material characteristics including the stress relaxation resistance characteristic.

As will be seen from the foregoing, the alloys of the invention exhibit an excellent stress relaxation resistance characteristic along with good strength, migration resistance, stress corrosion crack resistance, soldering heat resistance and the like, and thus, are adapted for use as terminals and connectors.

What is claimed is:

1. A copper alloy consisting essentially of from 0.1 wt % to less than 0.5 wt % of Ni, from larger than 1.0 wt % to less than 2.5 wt % of Sn, from larger than 1.0 wt % to 15 wt % of Zn, at least one selected from the group consisting of from 0.0001 wt % to less than 0.05 wt % of P and from 0.0001 wt % to 0.005 wt % of Si, and a balance of Cu and inevitable impurities, wherein a stress relaxation rate of the copper alloy is 30% or less after 1000 hours at 160° C.

2. The copper alloy according to claim 1, comprising from 0.0001 to 1 wt %, in total, of at least one element selected from the group consisting of Ti, Mg, Ag and Fe provided that the content of Ti ranges from 0.0001 to 0.2 wt %, that of Mg ranges from 0.0001 to 0.2 wt %, that of Ag ranges from 0.0001 to 0.2 wt %, and that of Fe ranges from 0.0001 to 0.6 wt %.

3. The copper alloy according to claim 2, comprising one or more of Ca, Mn, Be, Al, V, Cr, Co, Zr, Nb, Mo, In, Pb, Hf, Ta, B, Ge and Sb in a total amount of 1 wt % or below.

4. The copper alloy according to claim 1, comprising one or more of Ca, Mn, Be, Al, V, Cr, Co, Zr, Nb, Mo, In, Pb, Hf, Ta, B, Ge and Sb in a total amount of 1 wt % or below.

5. A copper alloy consisting essentially of from 0.1 wt % to less than 0.5 wt % of Ni, from larger than 1.0 wt % to less than 2.5 wt % of Sn, from larger than 1.0 wt % to 15 wt % of Zn, from larger than 0.0005 wt % to 0.005 wt % of S at least one selected from the group consisting of from 0.0001 wt % to less than 0.05 wt % of P and from 0.0001 wt % to 0.005 wt % of Si, not larger than 50 ppm of O, not larger than 10 ppm of H, and a balance of Cu and inevitable impurities, wherein a stress relaxation rate of the copper alloy is 30% or less after 1000 hours at 160° C.

6. The copper alloy according to claim 5, comprising from 0.0001 to 1 wt %, in total, of at least one element selected from the group consisting of Ti, Mg, Ag and Fe provided that the content of Ti ranges from 0.0001 to 0.2 wt %, that of Mg ranges from 0.0001 to 0.2 wt %, that of Ag ranges from 0.0001 to 0.2 wt %, and that of Fe ranges from 0.0001 to 0.6 wt %.

7. The copper alloy according to claim 6, comprising one or more of Ca, Mn, Be, Al, V, Cr, Co, Zr, Nb, Mo, In, Pb, Hf, Ta, B, Ge and Sb in a total amount of 1 wt % or below.

8. The copper alloy according to claim 5, further comprising one or more of Ca, Mn, Be, Al, V, Cr, Co, Zr, Nb, Mo, In, Pb, Hf, Ta, B, Ge and Sb in a total amount of 1 wt % or below.

9. A copper alloy according to claim 1, wherein an electrical conductivity of the copper alloy is equal to or less than 90% of a maximum electrical conductivity attained after annealing the copper alloy at 500° C. for four hours.

10. A copper alloy according to claim 5, wherein an electrical conductivity of the copper alloy is equal to or less than 90% of a maximum electrical conductivity attained after annealing the copper alloy at 500° C. for four hours.

11. A copper alloy according, to claim 1, wherein an area ratio of insoluble matter in the copper alloy is 5% or below.

12. A copper alloy according to claim 5, wherein an area ratio of insoluble matter in the copper alloy is 5% or below.

13. A method of making a stress relaxation resistant copper alloy, the method comprising annealing a rolled copper alloy, and forming the copper alloy of claim 1.

14. A method of making a stress relaxation resistant copper alloy, the method comprising annealing a rolled copper alloy, and forming the copper alloy of claim 5.

* * * * *

UNITED STATES PATENT AND TRADEMARK OFFICE

CERTIFICATE OF CORRECTION

PATENT NO. : 6,136,104

DATED : October 24, 2000

INVENTOR(S): Motohisa MIYAFUJI, et al.

It is certified that an error appears in the above-identified patent and that said Letters Patent is hereby corrected as shown below:

On the Title page, Item [73], the Assignee information is listed incorrectly.
Item [73] should read as follows:

--- [73] Assignee: Kabushiki Kaisha Kobe Seiko Sho, Kobe, Japan ---

Signed and Sealed this

Twenty-second Day of May, 2001

*Attest:*

Nicholas P. Godici

NICHOLAS P. GODICI

*Attesting Officer*

*Acting Director of the United States Patent and Trademark Office*